US009021635B1

(12) United States Patent
Leach

(10) Patent No.: US 9,021,635 B1
(45) Date of Patent: May 5, 2015

(54) BODY PILLOW WITH MULTIPLE CONFIGURATIONS

(76) Inventor: Jamie S. Leach, Ada, OK (US)

( * ) Notice: Subject to any disclaimer, the term of this patent is extended or adjusted under 35 U.S.C. 154(b) by 934 days.

(21) Appl. No.: 12/482,020

(22) Filed: Jun. 10, 2009

(51) Int. Cl.
*A47G 9/00* (2006.01)
*A47G 9/10* (2006.01)
*A47C 20/02* (2006.01)

(52) U.S. Cl.
CPC ..... *A47C 20/02* (2013.01)
USPC ..... 5/632; 5/630

(58) Field of Classification Search
CPC ..... A47G 9/00; A47G 9/10
USPC ..... 5/630–633, 636, 657, 652–653, 655
See application file for complete search history.

(56) References Cited

U.S. PATENT DOCUMENTS

| | | | | |
|---|---|---|---|---|
| 2,953,793 | A | 9/1960 | Rossi | |
| 3,327,330 | A | 6/1967 | McCullough | |
| 3,899,797 | A | 8/1975 | Gunst | |
| D299,988 | S | 2/1989 | Parabita | |
| 4,834,459 | A | 5/1989 | Leach | |
| 4,861,109 | A | 8/1989 | Leach | |
| D303,897 | S | 10/1989 | Phillips | |
| D309,018 | S | 7/1990 | Leach | |
| D318,969 | S | 8/1991 | Byrn | |
| 5,103,514 | A | 4/1992 | Leach | |
| 5,325,818 | A | 7/1994 | Leach | |
| 6,052,848 | A | 4/2000 | Kelly | |
| 6,088,854 | A | 7/2000 | Brownrigg | |
| 6,343,727 | B1 | 2/2002 | Leach | |
| 6,427,251 | B1 | 8/2002 | Leach | |
| 6,499,164 | B1 | 12/2002 | Leach | |
| 6,553,590 | B1 | 4/2003 | Leach | |
| 6,601,252 | B1 | 8/2003 | Leach | |
| 6,751,817 | B1 | 6/2004 | Leach | |
| 6,760,934 | B1 | 7/2004 | Leach | |
| 6,795,990 | B1 * | 9/2004 | Hutchinson | 5/632 |
| 6,874,183 | B1 | 4/2005 | Taylor | |
| 7,010,821 | B1 | 3/2006 | Leach | |
| 7,114,206 | B2 | 10/2006 | Leach | |
| 7,331,073 | B2 * | 2/2008 | Littlehorn et al. | 5/655 |
| 7,353,552 | B2 | 4/2008 | Leach | |
| 7,500,278 | B2 | 3/2009 | Leach | |

(Continued)

OTHER PUBLICATIONS

The Leachco Two-By-You product shown in the packaging material attached as Exhibit 1 was in public use and/or on sale at least since about Oct. 12, 2005.

(Continued)

*Primary Examiner* — Fredrick Conley
(74) *Attorney, Agent, or Firm* — Mary M. Lee

(57) ABSTRACT

A reconfigurable support pillow comprising an elongate center section with a short, curved arm on each end. Between each of the arms and the center section is a substantially flat connecting section with inwardly curved side edges. This shape allows the pillow to be placed into several configurations. In a first configuration, the center section is bent and the connecting sections overlap each other without creating a thickened area at the point where the connecting sections cross. Additionally, the curved ends of the pillow arms can be overlapped providing an oval configuration with a double thickness at one side. Still further, the pillow can be used with the center section straight and curved arms turned inward towards each other. Each configuration provides different advantages and use. The pillow may comprise a washable cover with removable inserts.

18 Claims, 8 Drawing Sheets

(56) References Cited

U.S. PATENT DOCUMENTS

| | | | |
|---|---|---|---|
| 7,513,001 | B1 | 4/2009 | Leach |
| 7,562,406 | B1 | 7/2009 | Leach |
| 2005/0278864 | A1 | 12/2005 | Leach |
| 2006/0031992 | A1 | 2/2006 | Moore |
| 2007/0022526 | A1 | 2/2007 | Leach |
| 2007/0028384 | A1 | 2/2007 | Leach |
| 2007/0046084 | A1 | 3/2007 | Leach |
| 2007/0151031 | A1 | 7/2007 | Leach |
| 2007/0277321 | A1 | 12/2007 | Leach |
| 2008/0028529 | A1 | 2/2008 | Abell |

OTHER PUBLICATIONS

The Leachco Lil' Snoogle product, which is shown and described in the webpage attached as Exhibit 2, was in public use and/or on sale at least as early as about Dec. 1999.

The Leachco All Nighter product, which is shown and described in the webpage attached as Exhibit 3, was in public use and/or on sale at least as early as about May 2002.

The Leachco Prop Ease product, which is shown and described in the packaging material attached as Exhibit 4, was in public use and/or on sale at least as early as about 2005.

The Leachco Snoogle product, which is shown and described in the webpage attached as Exhibit 5, was in public use and/or on sale at least as early as about May 1999.

The Leachco Mini Snoogle product, which is shown and described in the webpage attached as Exhibit 6, was in public use and/or on sale at least as early as about Dec. 1999.

The Leachco Snoogle Loop product, which is shown and described in the webpage attached as Exhibit 7, was in public use and/or on sale at least as early as about Dec. 1999.

The Leachco Snoozoo product, which is shown and described in the webpage attached as Exhibit 8, was in public use and/or on sale at least as early as about May 2005.

The Leachco Snoogle Half-Time product, which is shown and described in the webpage attached as Exhibit 9, was in public use and/or on sale at least as early as about Jul. 2005.

The Leachco Back 'n Belly product, which is shown and described in the webpage attached as Exhibit 10, was in public use and/or on sale at least as early as about Jun. 2003.

The Leachco Grow to Sleep pillow, which is shown and described in the webpage attached as Exhibit 11, was in public use and/or on sale at least as early as about Aug. 8, 2005.

The Leachco Preggle product, which is shown and described in the webpage attached as Exhibit 12, was in public use and/or on sale at least as early as about Dec. 2006.

The Leachco Boomerest pillow, which is shown and described in the webpage attached as Exhibit 13, was in public use and/or on sale at least as early as about May 23, 2005.

The Leachco Nogster pillow, which is shown and described in the webpage attached as Exhibit 14, was in public use and/or on sale at least as early as about Jul. 17, 2006.

* cited by examiner

BODY PILLOW WITH MULTIPLE CONFIGURATIONS

FIELD OF THE INVENTION

The present invention relates generally to body support pillows.

BACKGROUND OF THE INVENTION

Body support pillows enjoy increasing popularity among consumers. While one major use is to provide back and belly support for expectant mothers, many others use body pillows for general back and leg support while sleeping or reclining. While many body pillows presently are available, there remains a need for more versatility. The pillow of the present invention addresses this need.

DETAILED DESCRIPTION OF THE PREFERRED EMBODIMENTS

Figure 1:
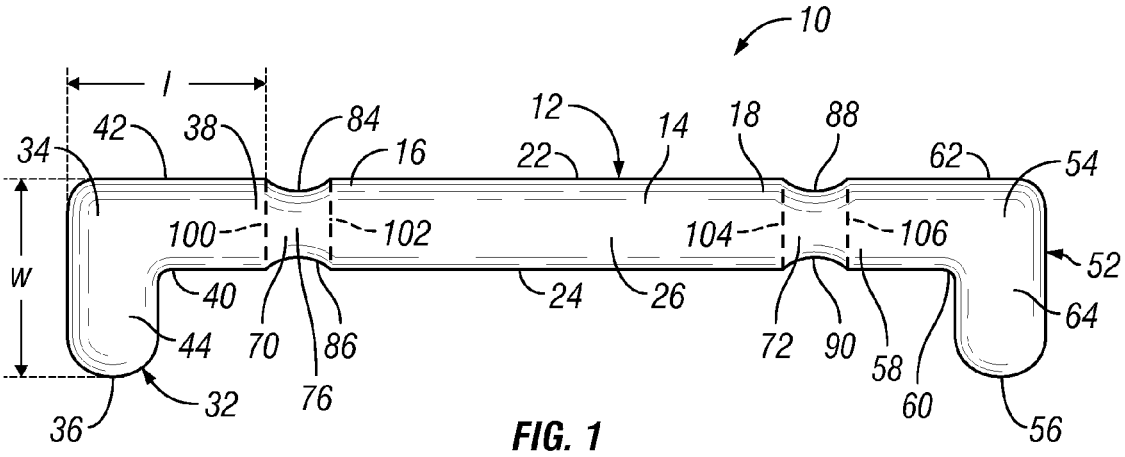
FIG. 1 is a plan view of a support pillow made in accordance with a preferred embodiment of the present invention. The pillow is shown in its resting position.
Figure 2:
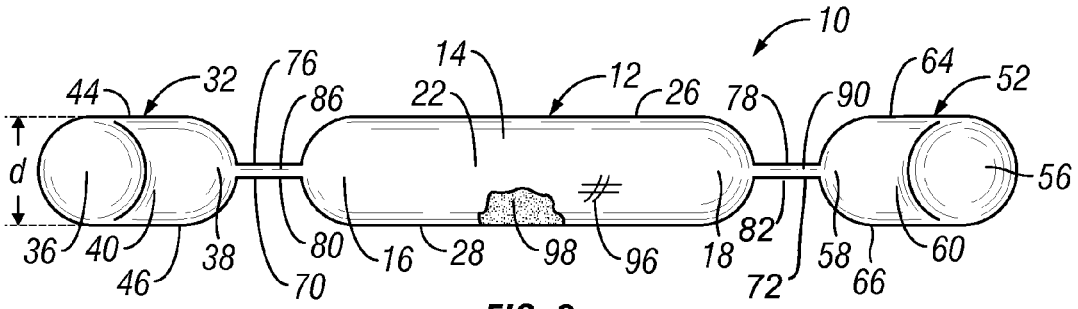
FIG. 2 is a side elevational view of the support pillow in FIG. 1.

Turning now to the drawings in general and to FIGS. 1-2 in particular, there is shown therein a support pillow made in accordance with a preferred embodiment of the present invention and designated generally by the reference numeral 10. The pillow 10 comprises a center section 12. In the preferred embodiment, the center section 12 comprises an elongate body 14 with a first end 16 and a second end 18. The center section has a first side 22, a second side 24, a top 26, and a bottom 28. Still further, the center section is characterized by a length (from the end of the first end 16 to the end of the second end 18), a width (from the first side 22 to the second side 24), and a depth (from the top 26 to the bottom 28).

In a most preferred configuration, the center section 12 is generally cylindrical having a substantially constant diameter along the length of the body 14. The length and other dimensions may vary. However, preferred dimensions include a length from about 40 to about 48 inches and a diameter of about 6 to about 8 inches.

The pillow 10 further comprises a first arm 32 comprising a curved body 34, a first free end 36, a second end 38. The first arm 32 has a first side 40, a second side 42, a top 44, and a bottom 46. Additionally, it is characterized by a length "l," a width "w," and a depth "d," as indicated in FIGS. 1 and 2.

Referring still to FIGS. 1 and 2, the pillow 10 comprises a second arm 52 similar to the first arm 32. The second arm 52 comprises comprising a curved body 54, a first free end 56, and a second end 58. The second arm 52 has a first side 60, a second side 62, a top 64, and a bottom 66. Additionally, it is characterized by a length (see the dimensions as indicated for the first arm 32).

The dimensions, shape, and overall size of the first and arms 32 and 52 may vary. Preferably, the arms 32 and 52 are the same size and shape and are symmetrically configured. More preferably, the arms 32 and 52 curve toward the same side of the center section 12, forming minor images of each other. Most preferably, the width and depth, or diameter, of the first and second arms are about the same as the diameter (or width and depth) of the center section 12, although the curved arms may be slightly wider at the elbow portion. The preferred length "l" of the arms 32 and 52 is from about 20 to about 28 inches and most preferably about 24 inches. The preferred width "w" of the arms 32 and 52 is from about 20 to about 28 inches and most preferably about 24 inches.

The pillow 10 further comprises first and second connecting sections 70 and 72. The first connecting section 70 extends between the first end 16 of the center section 12 and second end 38 of the first arm 32. The second connecting section 72 extends between the second end 18 of the center section 12 and the second end 58 of the second arm 52.

As best shown in FIG. 2, each of the connecting sections 70 and 72 is relative flat compared to the center section 12 and the arms 32 and 52. Each has a top 76 and 78 and a bottom 80 and 82, and each has first and second side edges 84, 86, 88 and 90. Preferably, the first and second side edges 84, 86 and 88, 90 is curved inwardly, as this facilitates twisting, bending and overlapping of the connecting sections 70 and 72.

The center section 12 and the first and second arms 32 and 52 all are formed of compressible, resilient material so that the pillow 10 provides good cushioning and returns to its original shape or resting position after being deformed. As used herein, "resting position" refers to the position and shape the pillow 10 naturally assumes when no tension or pressure is exerted on any part of it. The resting position of the pillow 10 is shown in FIGS. 1 and 2.

As indicated, the connecting sections 70 and 72 are relatively flat, but they may have a small mount of filler or other cushioning, such as batting, in them. In the preferred embodiment shown and described herein, the width (from the first side 84, 86 to the second side 88, 90) of the connecting sections 70 and 72 is about the same as the width of the center section 12 and the second ends 38 and 58 of the first and second arms 32 and 52. However, in this most preferred form, the depth or thickness (from the top 76, 78 to the bottom 80, 82) of the connecting sections 70 and 72 preferably is only about ½ to 1 inch.

One of the functions of the thin connecting sections 70 and 72 is to allow the sections to cross each other without creating additional thickness (greater than the diameter of the center section 12) at the point of intersection. To that end, the connecting sections 70 and 72 in other embodiments may be less than about half the depth or diameter of the center section 12, or more preferably is less than about a quarter of the depth of the center section, and even more preferably is less than about 3 three inches thick.

In the preferred embodiment, the two connecting sections 70 and 72 are similarly sized and shaped, that is, the width, length, and depth of the first connecting section is about the same as the width, length, and depth of the second connecting section. However, in order for the connecting sections 70 and 72 to overlap as smoothly as possible, the length of the second connecting section 72 should be at least the same as or greater than the width of the first connecting section 70, and vice versa. In the preferred embodiment, the connecting sections 70 and 72 are about 8 inches square, though this will vary with the diameter of the center section 12.

As best seen in FIG. 2, the pillow 10 preferably comprises a fabric enclosure 96 filled with a compressible, resilient material 98. The fabric enclosure 96 material may be any suitable fabric, including but not limited to waterproof nylon, flannel, muslin, or elastic fabrics, such as spandex or cotton-spandex blends. However, presently a polyester/cotton blend is preferred. The compressible, resilient material 98 may be solid or loose. For example, a preferred loose filler is polyester fiberfill. Other suitable fillers include down feathers, memory foam, and polystyrene pellets. In some instances, the pillow 10 may comprise an inflatable enclosure. This construction provides a continuous compressible and resilient pillow form.

The fabric enclosure 96 may be formed by cutting two pieces of fabric in the desired shape, stitching the seam around the entire periphery, and then turning the enclosure inside out to place the selvages on the inside of the enclosure. Small openings left in the seam in each section of the enclosure 96 allow for the insertion of the filler material. The sections in the pillow are formed by stitching cross-wise at the desired positions for the connecting sections 70 and 72; cross seams 100, 102, 104, and 106 (FIG. 1) delineate the center section 12, the arms 32 and 52, and the connecting sections 70 and 72. Then, the desired amount of filler may then be placed inside each of the sections. Alternately, a sheet of batting cut to the shape of the connecting section may be stitched in place on one of the two pieces of the fabric so that the batting is permanently fixed inside the connecting section when the pieces are sewn together and turned inside out. Various other methods of forming and filling the enclosure will be readily apparent.

Having described a preferred structure for the pillow 10 of the present invention, its use now will be explained. One use for the pillow 10 is as a seat or study pillow, shown in FIGS. 3-6. In this configuration, the center section 12 is formed into a loop, and the first side and the arms 32 and 52 are crossed so the connecting sections 70 and 72 overlap. In this configuration, the looped center section 12 forms a back support and the arms 32 and 52 diverge to form a well or seat while the arms themselves serve as arm rests for the user.

Figure 3:
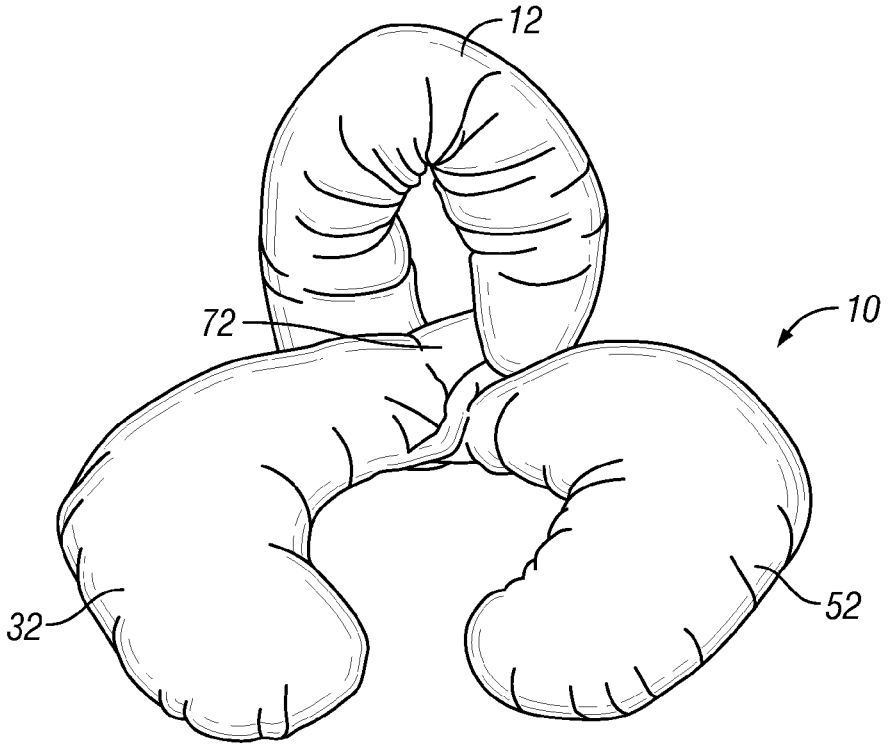
FIG. 3 is a frontal perspective view of the inventive support pillow shown in a first configuration with the center section bent into a loop and the connecting section overlapping forming a well.
Figure 4:
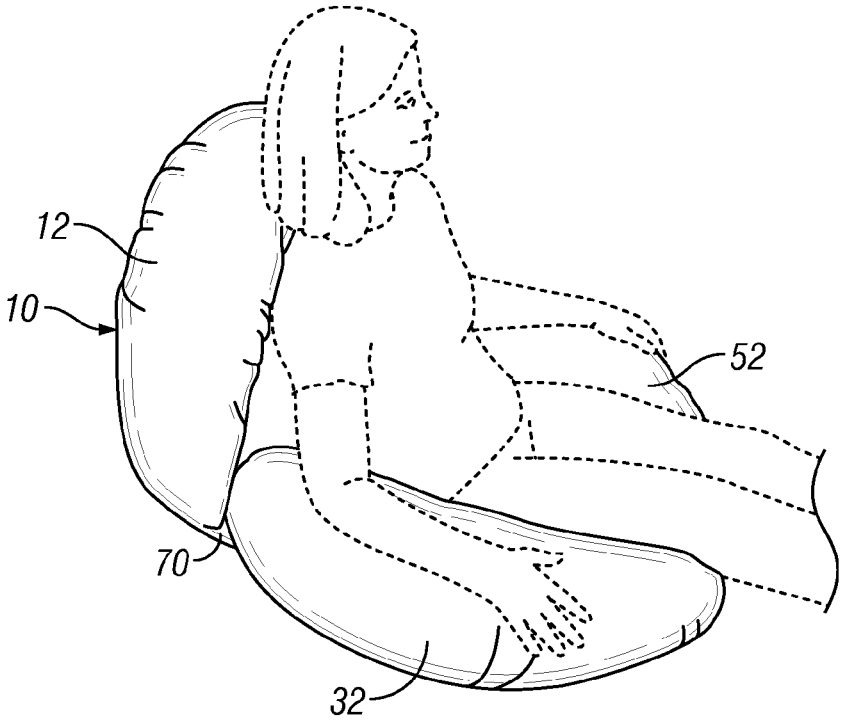
FIG. 4 is a side perspective view of the pillow configured as in FIG. 3 with a woman (shown in phantom) seated in it, the arms forming arm rests and the looped center section forming a back support.
Figure 5:
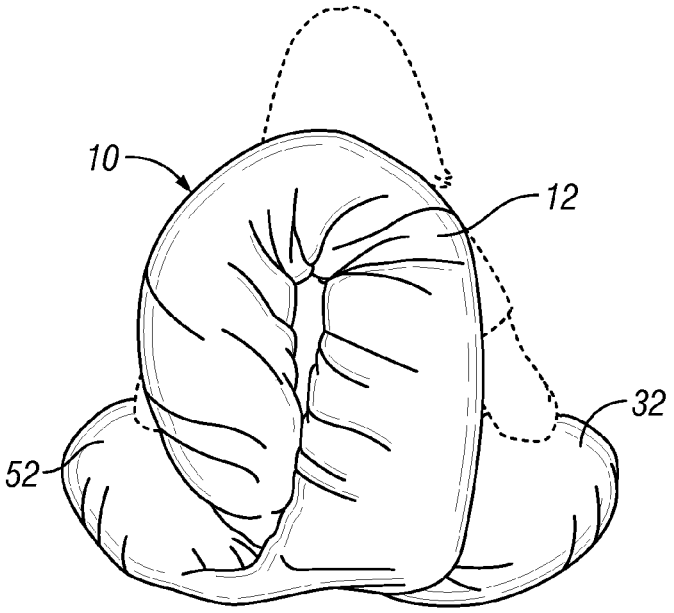
FIG. 5 is a rear perspective view of the pillow and woman shown in FIG. 4.
Figure 6:
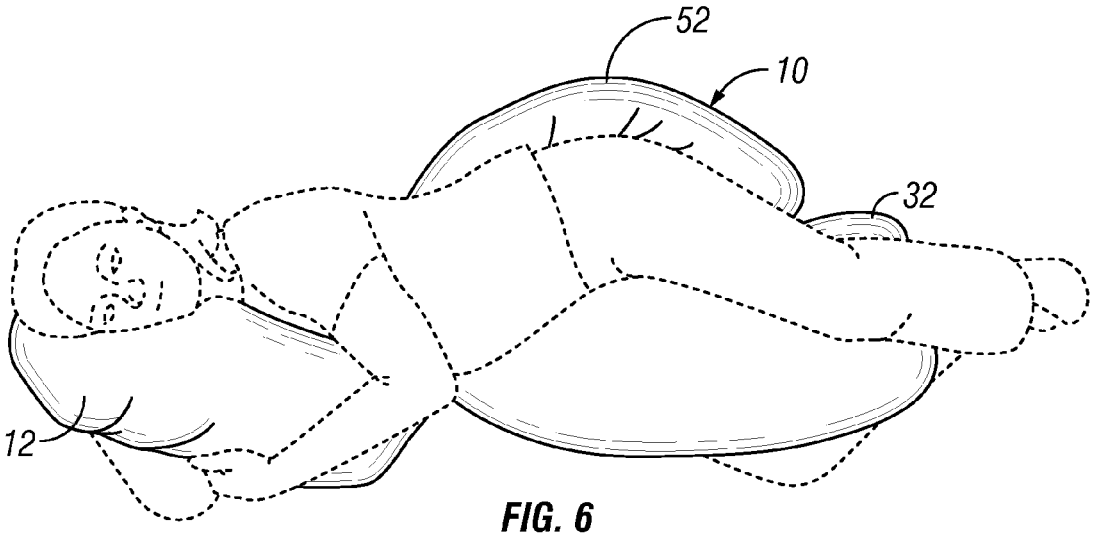
FIG. 6 is side perspective view of the pillow configured as in FIG. 3 with a woman (shown in phantom) lying in it, the arms forming leg supports and the looped center section forming a head and upper body support.

Although the pillow 10 is shown folded in FIGS. 3-5 at a roughly 90 degree angle, any angle of inclination may be formed, according to the user's comfort and location. Additionally, as illustrated in FIG. 6, the pillow may be left flat for use in a reclining position. In this configuration, the looped center section 12 forms a head and upper body support while the arms serve to separate and align the knees.

Figure 7:
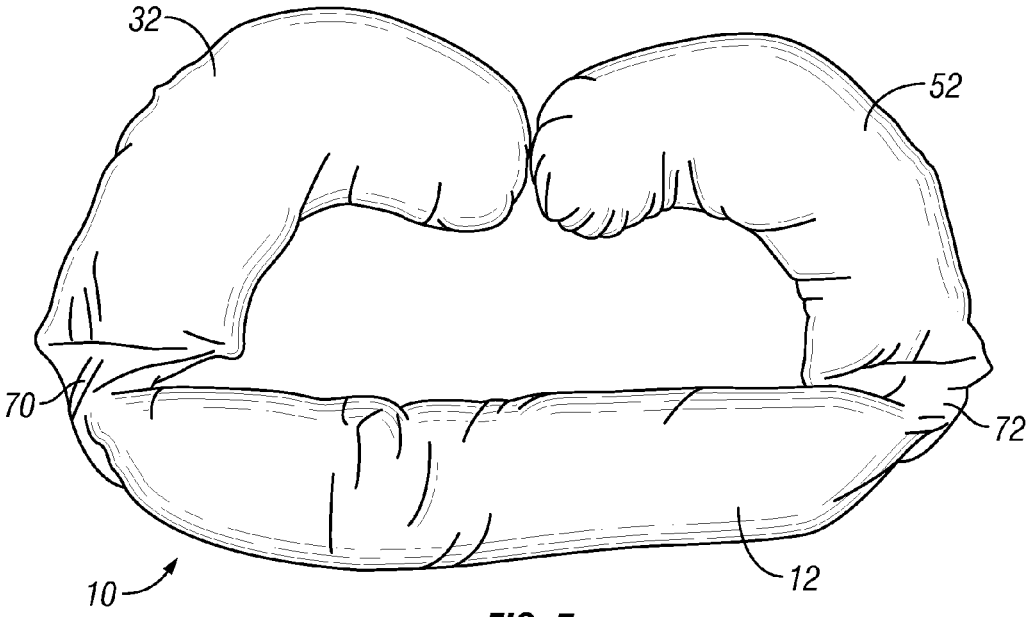
FIG. 7 is a plan view of the inventive pillow with the center section straight and the arms turned inward toward each other.
Figure 8:
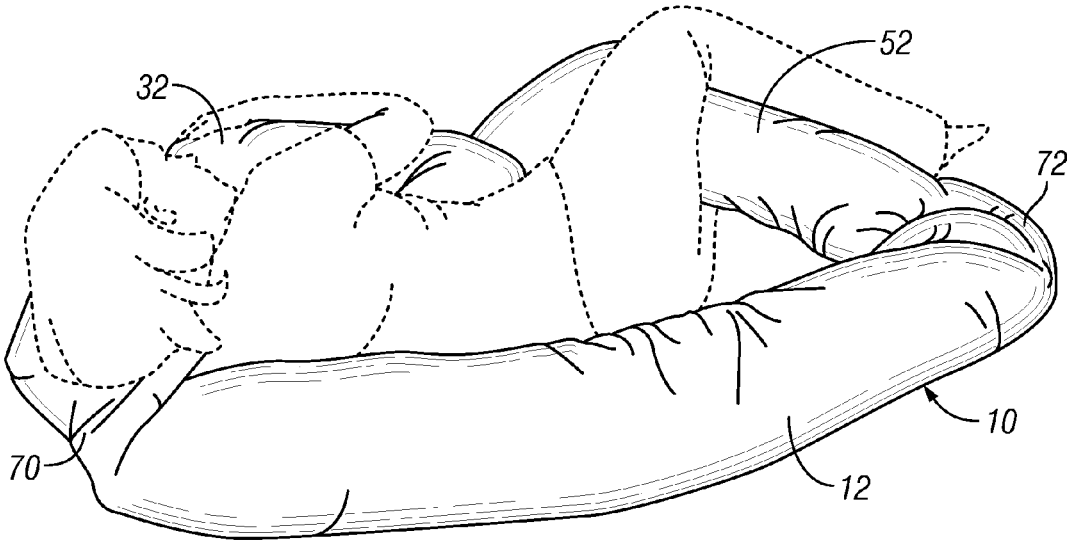
FIG. 8 is a rear perspective view of the pillow configured as in FIG. 7 with a woman (shown in phantom) lying in it, the center section providing a back support, one of the arms providing a head and upper body support, and the other arm providing a leg support.
Figure 9:
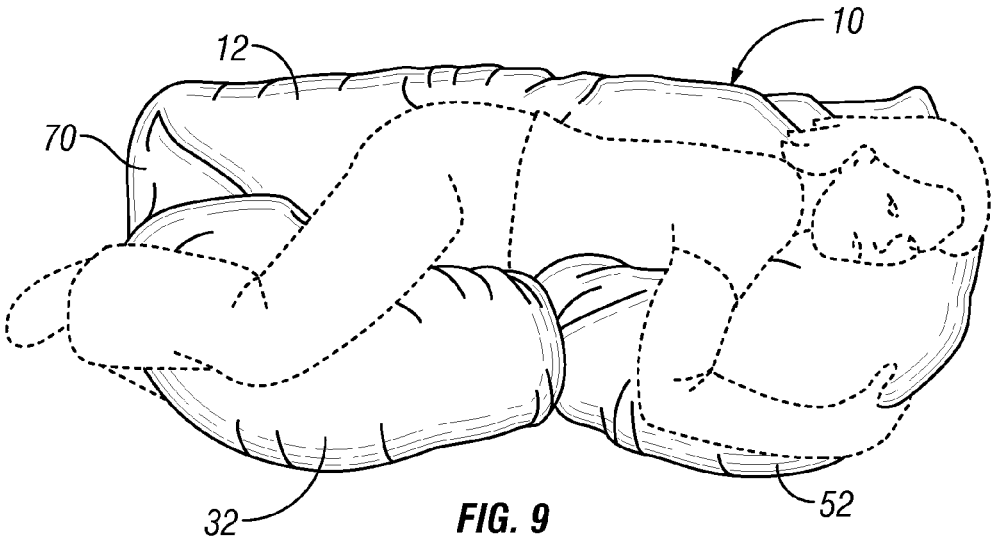
FIG. 9 is a front perspective view of the pillow and woman shown in FIG. 8.
Figure 10:
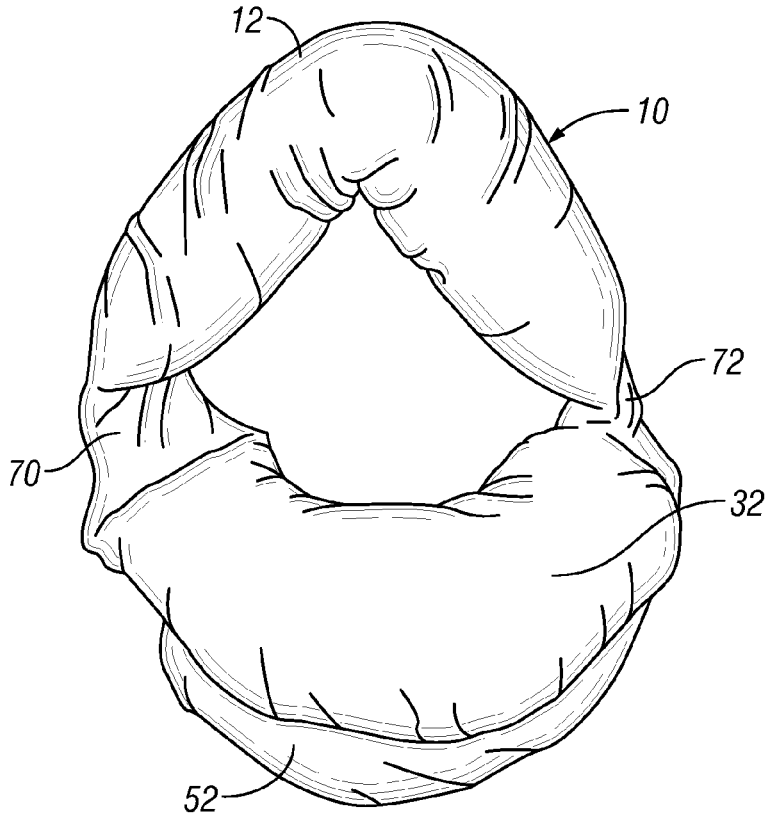
FIG. 10 a frontal perspective view of the pillow in yet another configuration with the center section bent into a loop, the arms overlapping each other, and the entire pillow folded at the connecting sections to form a seat.

With reference now to FIGS. 7-9, an alternate configuration for the pillow 10 is shown and described. In this configuration, the first and second arms 32 and 52 are turned inwardly slightly towards each other by flexing the connecting sections 70 and 72, while the center section 12 is left straight. This provides an excellent sleep support as shown in FIGS. 8 and 9, one arm supporting the head, one arm supporting the legs, and the center section supporting the back and hips.

Although not illustrated in FIGS. 7-9, the connecting sections 70 and 72 permit various modifications of the configurations shown. Because they are flat and loose (little or no filler), the connector sections 70 and 72 can be collapsed or folded easily. For example, the first and second ends 16 and 18 of the center section 14 easily can be pushed up and over the second ends 38 and 58 of the arms 32 and 52. Additionally, the flexibility of the connecting sections 70 and 72 allows the center section 12 to be easily offset or rotated relative to the arms 32 and 52. This allows for several variations of the configurations shown in the drawings herein.

Turning now to FIGS. 10-14, yet another configuration will be described. In this configuration, seen best in FIG. 10, the center section 12 is bent or folded but the connecting sections 70 and 72 are left spaced apart in roughly parallel position while the ends of the arms 32 and 52 are overlapped. This creates a generally circular or oval shape with a double thickness at one side formed by the overlapping arms. In this configuration, the pillow 10 may be used in a sitting or reclining position.

Figure 11:
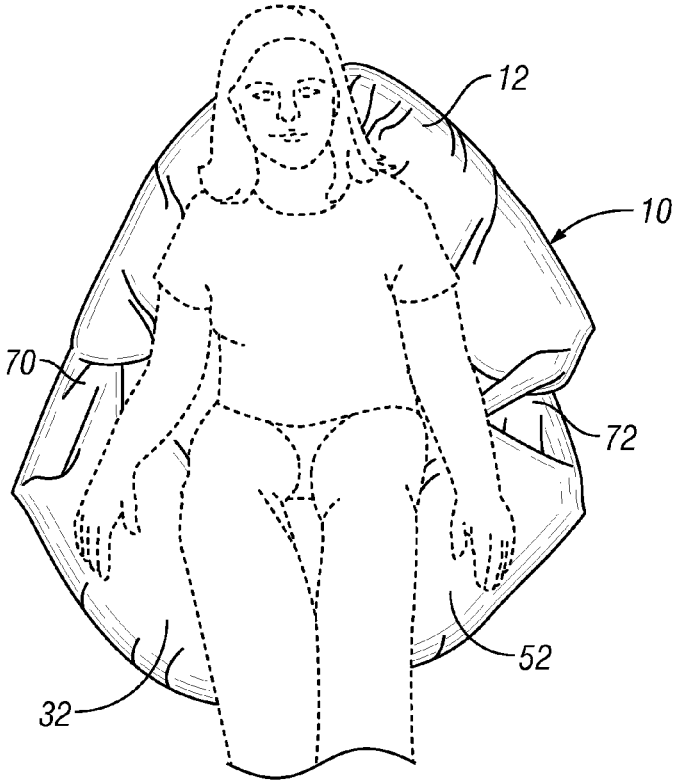
FIG. 11 is a frontal perspective view of the pillow configured as in FIG. 10 with a woman seated in it (shown in phantom), the overlapping arms forming an under-knee support and the looped center section forming a back support.

As shown in FIG. 11, with the pillow folded into an angle, a person can sit in it with her legs over the overlapping arms 32 and 52 and her back leaning on the looped center section 12. Alternately, although not depicted in the drawings, the user can sit on top of one of the overlapping arms 52 and place the other arm 32 across her lap for use as a lap pillow or nursing pillow. Still further, the user can sit with both arms 32 and 52 overlapped across her lap.

Figure 12:
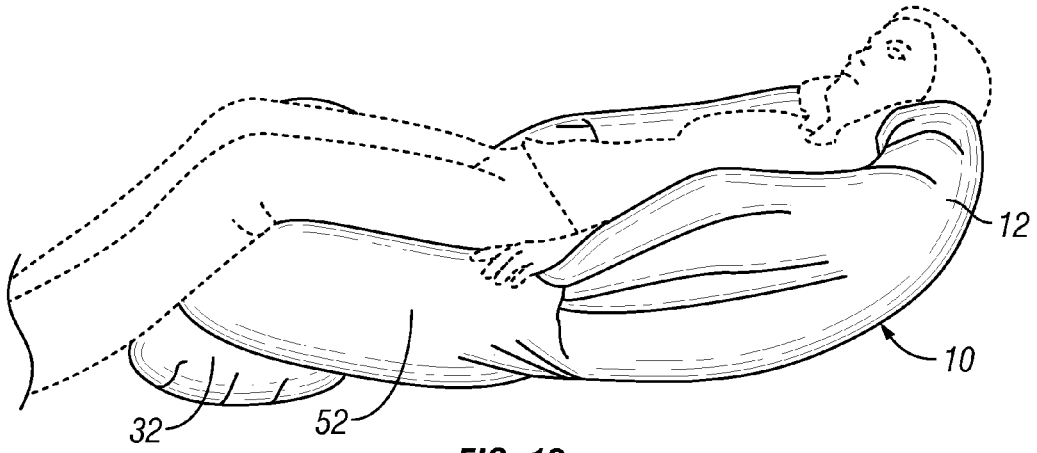
FIG. 12 is a side perspective view of the pillow in yet another configuration with the center section bent into a loop, the arms overlapping each other, but without folding the pillow at the connecting sections. A woman, shown in phantom, is reclining on her back in the pillow, the overlapping arms supporting her knees and the looped center section supporting her head.
Figure 13:
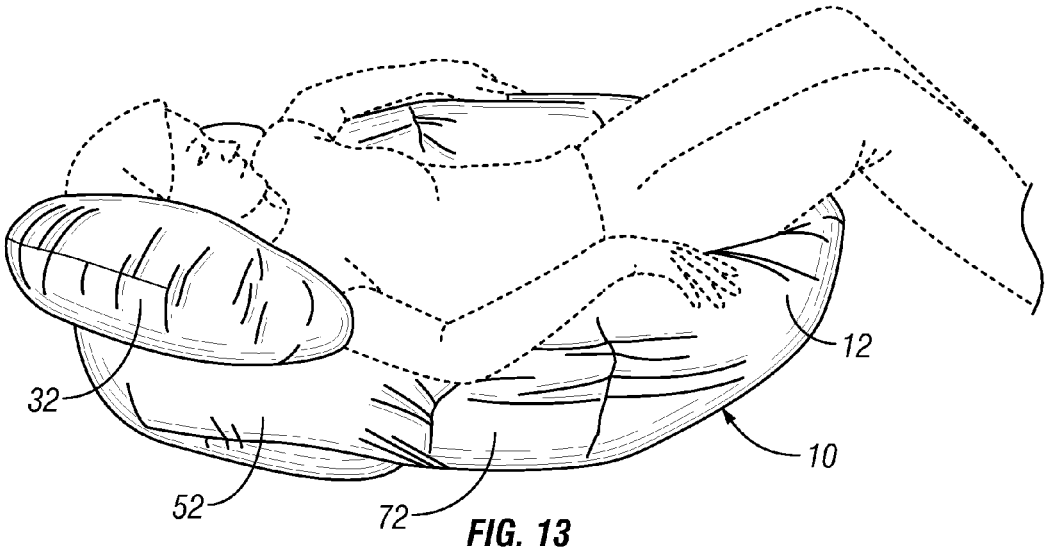
FIG. 13 is a side perspective view of the pillow in the configuration shown in FIG. 10. A woman, shown in phantom, is reclining on her back in the pillow, the overlapping arms supporting her head and the looped center section supporting her legs.
Figure 14:
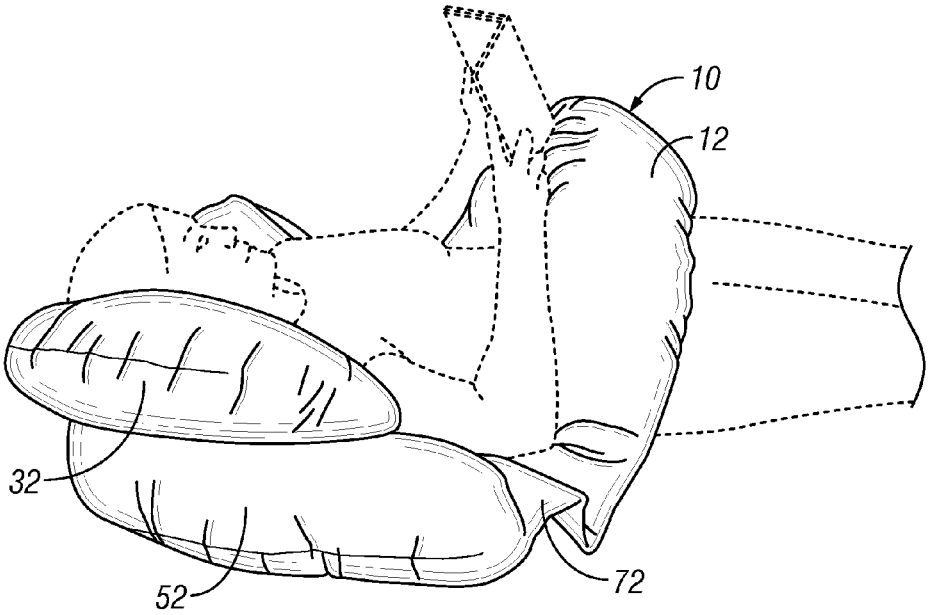
FIG. 14 is a side perspective view of the pillow in the configuration shown in FIG. 10. A woman, shown in phantom, is reclining on her back in the pillow, the overlapping arms supporting her head and the looped center section encircling her body and providing a book support.

FIG. 12 shows a woman reclining in the pillow in an unfolded condition, with her knees supported on the overlapping arms 32 and 52 and her head resting on the center section 12. FIG. 13 shows a woman reclining in the pillow also in an unfolded condition, but with her thighs supported on the center section 12 and her head on the overlapping arms 32 and 52.

Yet another use for this configuration is show in FIG. 4. In this application, the woman is reclining with center section 12 looped around her torso supporting a book. Her head rests on the overlapping arms 32 and 52.

Figure 15:
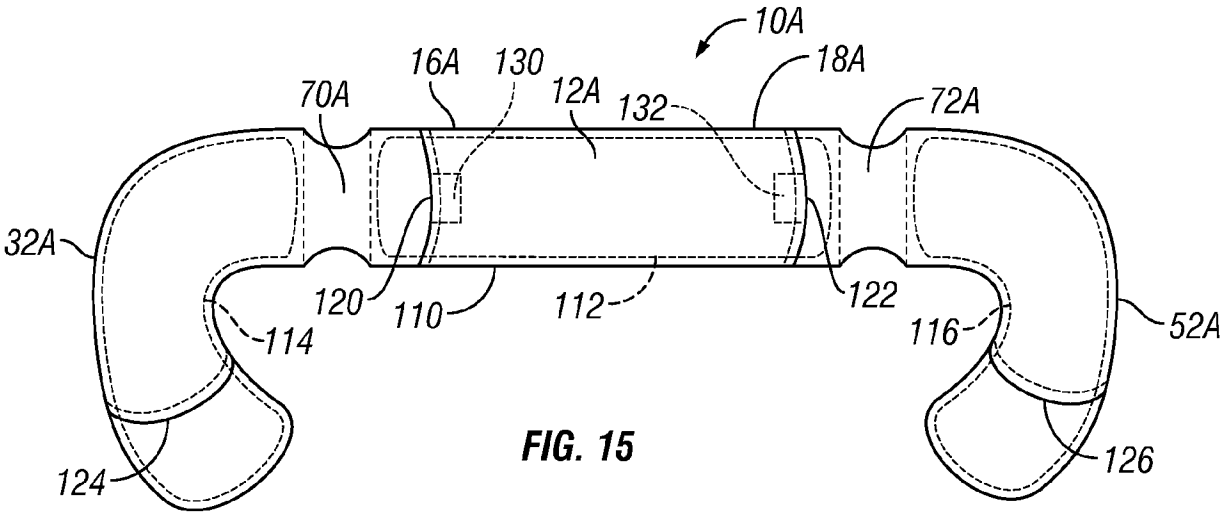
FIG. 15 is a bottom view of another preferred embodiment of the pillow of the present invention comprising a removable cover and connectors on the ends of the center section.

Turning now to FIG. 15, another embodiment of the pillow of the present invention is shown and designated generally by the reference numeral 10A. In this embodiment, the pillow 10A comprises is similarly formed with a center section 12A, connecting sections 70A and 72A, and first and second arms 32A and 52A. The center section 12A has first and second ends 16A and 18A. Although most of the dimensions are similar to those in the previous embodiment, the diameter of the arms 32A and 52A preferably is slightly larger than the diameter of the center section 12A.

In this embodiment the pillow further comprises a cover 110 and three removable inserts 112, 114, and 116. The insert 112 for the center section 12A is generally cylindrically shaped. The inserts 114 and 116 are curved. The inserts preferably are fabric enclosures filled with loose polyester filling, or any of the other filler materials mentioned previously. Alternately, the inserts may be solid form, or inflatable, or any other structure that provides compressibility and resilience. The pillow 10A may be used in all the ways previously described in connection with the first embodiment 10 shown in FIGS. 1-14.

The cover 110 is preferably a washable fabric and is formed much like the enclosure 96 of the first embodiment. However, in this embodiment the cover is provided with openings to permit insertion and removal of the inserts 112, 114, and 116. The size, position and type of the openings may vary. In the preferred embodiment shown, the openings comprise four slots: two slots 120 and 122, one near each end 16A and 18A of the center section, one slot 124 in the first arm 32A, and one slot 126 in the second arm 58.

In the present embodiment, the slots are simply overlapping edges without a closure mechanism, forming a sham style opening. However, the openings can be provided with closure mechanisms, such as zippers, buttons, snaps, hook-and-loop fasteners, ties, buckles, and others. Now it will be apparent that when the pillow 10A becomes soiled, the inserts 112, 114, and 116 can be removed and the cover laundered.

Figure 16:
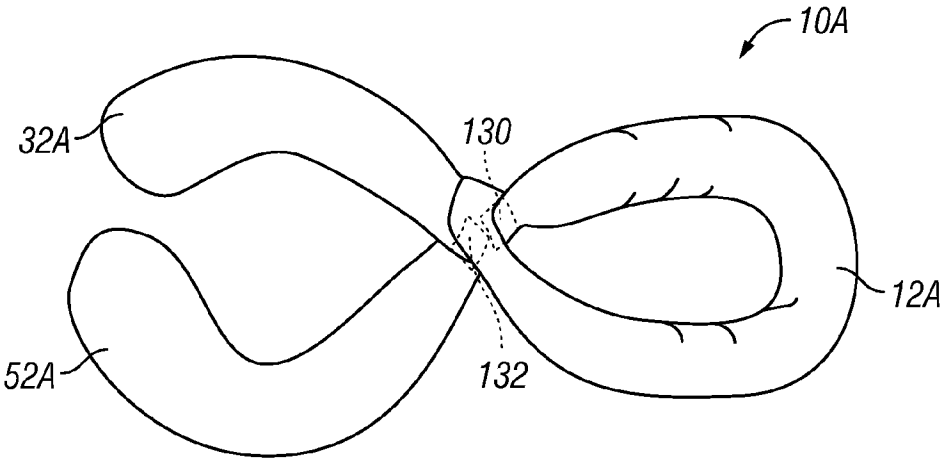
FIG. 16 is a plan view of the pillow shown in FIG. 15 with the center section folded in half and secured with the connectors.

Referring still to FIG. 15, the cover 110 preferably also includes connectors 130 and 132 on the ends 16A and 18A of the center section 12A. Most preferably, the connectors 130 and 132 comprise mating pieces of hook-and-loop fasteners and are ideally placed on the underside of one of the edges of the slots 120 and 122. When thus positioned, the connectors 130 and 132 can be attached to each other when the center section 12A is folded or bent into a loop, thus holding the pillow in the selected position, as shown in FIG. 16. Instead of hook-and-loop fasteners, the connectors 130 and 132 may comprise buttons, snaps, ties, buckles, and the like.

Now it will be appreciated that the pillow 10 of the present invention has many desirable features and advantages. It is ideal for use as a study pillow, either while sitting or reclining in bed. It also provides a versatile sleep pillow with multiple configurations for supporting and aligning the user's legs, for supporting the back, the head, and the upper and lower body. These and other uses and configurations will be readily apparent from the unique structure of this inventive pillow.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A body support pillow comprising:

a center section comprising an elongate body, a first end, and a second end, the center section having with a first side, a second side, a top, and a bottom, and characterized in a resting position by a length, a width, and a depth, wherein the length of the center section is greater than the width and the depth;

a first arm comprising a curved body, a first free end, and a second end, the first arm having a first side, a second side, a top, and a bottom, and characterized by a length, a width, and a depth;

a second arm comprising a curved body, a first free end, and a second end, the second arm having a first side, a second side, a top, and a bottom, and characterized by a length, a width, and a depth;

a first connecting section between the first end of the center section and the second end of the first arm;

a second connecting section between the second end center section and the second end of the second arm; and first and second connectors at the first and second ends, respectively, of the center section, the first connector releasably connected to the second connector whereby the center section is releasably secured in a looped configuration and so that, when the first and second connectors are disconnected, the center section can resume its resting position;

wherein the center section and first and second arms are all comprised of compressible, resilient material and have about the same depth and width, and wherein the first and second connecting sections have a length, a depth, and a width, and wherein the depth of the connecting sections is less than about half the depth of the adjoining one of the first and second arms and the center section.

2. The support pillow of claim 1 wherein the first and second arms are curved toward the same one of the first and second sides of the center section.

3. The support pillow of claim 1 wherein the width and depth of the first and second arms are about the same as the width and depth of the center section.

4. The support pillow of claim 1 wherein the width and length and depth of the first connecting portion is about the same as the width and length and depth, respectively, of the second connecting portion.

5. The support pillow of claim 1 wherein the depth of the connecting sections is less than about one-quarter of the depth of the center section.

6. The support pillow of claim 1 wherein the first and second arms are symmetrically shaped.

7. The support pillow of claim 6 wherein the first and second arms are curved toward the same one of the first and second sides of the center section.

8. The support pillow of claim 7 wherein center section is generally cylindrical having a substantially constant diameter along the length of the body.

9. The support pillow of claim 1 wherein the length of the first connecting section is about the same as the width of the second connecting section.

10. The support pillow of claim 9 wherein center section has a diameter of from about 6 inches to about 10 inches.

11. The support pillow of claim 10 wherein the center section has a length of about 40 to about 48 inches.

12. The support pillow of claim 11 wherein each of the first and second connecting sections has first and second side edges each forming an inward curve.

13. The support pillow of claim 1 wherein center section has a diameter of from about 6 inches to about 10 inches.

14. The support pillow of claim 13 wherein the center section has a length of about 40 to about 48 inches.

15. The support pillow of claim 14 wherein the depth of the first and second connecting sections is less than about 2 inches.

16. The support pillow of claim 1 wherein each of the first and second connecting sections has first and second side edges each forming an inward curve.

17. The support pillow of claim 16 wherein the length of the first connecting section is about the same as the width of the second connecting section.

18. The support pillow of claim 1 wherein the pillow comprises a fabric cover with a plurality of removable inserts including one for each of the center section, first and, and second arm.

* * * * *